US006155152A

United States Patent [19]

Bilstein et al.

[11] Patent Number: 6,155,152

[45] Date of Patent: Dec. 5, 2000

[54] KNIFE HOLDER FOR A WRAPPER CUTTER WITH A HAND GUARD

[75] Inventors: Willi Bilstein, Overath; Ingo Picker, Much, both of Germany

[73] Assignee: Wilhelm Bilstein KG Spezialfabrik für Rundmesser und Plattenventile, Overath, Germany

[21] Appl. No.: 09/284,273

[22] PCT Filed: Jun. 15, 1998

[86] PCT No.: PCT/EP98/03595

§ 371 Date: Apr. 12, 1999

§ 102(e) Date: Apr. 12, 1999

[87] PCT Pub. No.: WO99/07529

PCT Pub. Date: Feb. 18, 1999

[30] Foreign Application Priority Data

Aug. 11, 1997 [DE] Germany ..... 297 14 312 U

[51] Int. Cl.[7] ..... B26D 1/24

[52] U.S. Cl. ..... 83/397; 478/553; 478/500

[58] Field of Search ..... 83/478, 481, 482, 83/546, 545, 397.1, 397, 398, 553, 500

[56] References Cited

U.S. PATENT DOCUMENTS

| | | | |
|---|---|---|---|
| 2,802,528 | 8/1957 | Mastriani | 83/482 |
| 5,131,304 | 7/1992 | Paavola | 83/478 |
| 5,370,026 | 12/1994 | Cavagna | 83/478 |
| 5,546,840 | 8/1996 | Supe-Dienes | 83/478 |

FOREIGN PATENT DOCUMENTS

| | | |
|---|---|---|
| 0 562 454 | 9/1993 | European Pat. Off. . |
| 87 05 312 | 7/1987 | Germany . |

*Primary Examiner*—M. Rachuba
*Assistant Examiner*—Dominic Troiano
*Attorney, Agent, or Firm*—Venable; Geroge H. Spencer; Gabor J. Kelemen

[57] ABSTRACT

A knife holder for holding a knife head has a circular wrapper cutter with a blade rotatably mounted in the knife head for engagement with a lower cutter to cause lengthwise separation of a material web. The knife holder has a base body for positioning the knife head and is mounted to a knife holder bar. A tie bar moves the knife head between a resting position and a cutting position where an area of the blade is exposed and is operatively engaged with the cutter. A protective hood covers at least a portion of the circumference of the circular wrapper cutter and is movable relative to the circular wrapper cutter between an operating position where the blade is exposed and a protective position where the protective hood covers at least a side of the blade. A pullback spring disposed between the protective hood and the tie bar holds the protective hood in the operating position when the wrapper cutter is in the cutting position, and a limit stop disposed on the base body pushes the protective hood into the protective position when the upper cutter is in the resting position.

8 Claims, 3 Drawing Sheets

KNIFE HOLDER FOR A WRAPPER CUTTER WITH A HAND GUARD

BACKGROUND OF THE INVENTION

The invention relates to a knife holder for a circular wrapper cutter, positioned so as to rotate inside a knife head, for the lengthwise separation of material webs, in particular material webs made of paper or plastic foil, wherein the circular wrapper cutter is provided with a hand guard.

Narrow material strips are produced from the originally wide material webs by separating material webs in lengthwise direction with the aid of circular wrapper cutters that operate according to the scissor cut method, wherein the strip width depends on the respective application case. In order to produce the narrowest possible strips or ribbons, the knife holders that must be arranged side-by-side on a knife holder bar, at a corresponding distance to each other, should have the narrowest possible overall width since the minimum possible cutting width is essentially determined by this overall width. For reasons of operational safety, it is particularly important that the worker be protected during the adjustment operations against injuries caused by the circular wrapper cutter, wherein it is known to provide the circular wrapper cutter with a cover that is adjustable if necessary. Depending on the cover design, the problem arises that the overall width of the knife holder is increased, thereby causing a decrease in the minimum possible cutting width.

The German Patent DE-PS 37 12 078 discloses a knife holder for reel cutters with a hand guard, complemented by at least one box-type segment on the side facing the counter cutter. This box-type segment can be operated via a separate piston-cylinder unit that is connected in series with the piston-cylinder unit. In the circular cutter position where the circular cutter is lifted off the counter cutter, the box-type segment is closed via spring force. During the movement for lowering the circular cutter, both piston cylinder units are admitted with hydraulic fluid, so that the box-type segment pivots into the hand guard and exposes the blade of the circular cutter. In addition to the high design expenditure for an additional piston cylinder unit, such a knife holder has the disadvantage of requiring a larger overall width for the knife holder.

A similar arrangement with a two-part protective hood is disclosed in the European Patent EP-A-0 562 454, wherein the part of the protective hood which faces the counter cutter and is designed as box-type segment provided with a slot is positioned such that it can be displaced vertically. The box-type segment in this case is also moved with the aid of a separate piston-cylinder unit. In the position where the circular cutter is raised, the box-type segment is held in the closed position with the aid of a closing spring and is pulled back with the aid of the piston during the lowering movement, so that the blade of the circular cutter can extend through the slots. A hand guard designed in this way is expensive and subject to malfunctions because of the multi-part design and the necessary complicated adjustment mechanism.

The EP-A-0 333 001 discloses a knife holder with a protective hood as hand guard. This hood is attached stationary to the base body of the knife holder and covers the circular cutter completely when it is in the raised position. When the circular cutter is lowered toward the counter cutter, the circular cutter moves out of the stationary protective hood.

The reference DE-U-90 12 926 also discloses a knife holder for reel cutters where the circular cutter is surrounded on the side as well as on the side facing away from the counter cutter by a fixed hand guard and where the cutting range of the knife is covered by a movable segment which is also opened and closed with the aid of an involved operating device.

SUMMARY OF THE INVENTION

Thus, it is the object of the invention to create a knife holder for a circular wrapper cutter which, given a narrow overall width, ensures good operational safety for the hand guard along with the simplest possible design.

This object is solved according to the invention with a knife holder for a circular wrapper cutter that is positioned so as to rotate inside a knife head and is used for separating material webs in lengthwise direction, comprising a base body secured to a knife holder bar on which the knife head is positioned such that it can be moved back and forth across a tie-bar between a resting position and a cutting position, further comprising a protective hood that covers the circular wrapper cutter over at least a portion of its circumference and is positioned relative to the circular wrapper cutter, such that in the cutting position the blade region that is operatively engaged with a lower cutter is exposed and that in the resting position, the blade is covered at least on the side by the protective hood. The knife holder further comprises a pull-back spring, arranged to be effective between the protective hood and the tie-bar, so that in the cutting position of the circular wrapper cutter, it keeps the protective hood in the operating position where the blade of the circular wrapper cutter is exposed and that while the circular wrapper cutter is in the resting position, it pushes the protective hood with the aid of an limit stop arranged on the base body into a protective position in which the circular wrapper cutter is covered by the protective hood. The advantage of a knife holder designed according to the invention is that in the resting position of the knife head, the worker is protected against injuries caused by the circular wrapper cutter. The resting position of the knife head within the meaning of this invention is understood to be the position where the circular wrapper cutter is lifted off the associated lower cutter. In the resting position of the circular wrapper cutter, the worker can make adjustments to the knife holder and/or the circular wrapper cutter or can insert a material web into the gap between the raised circular wrapper cutter and the lower cutter. In the resting position of the circular wrapper cutter, a protective hood in the protective position covers the blade, so that injuries to the person working on the circular wrapper cutter are prevented. The protective position of the protective hood within the meaning of the invention is understood to mean that the protective hood is moved in the direction of the lower cutter and covers the circular wrapper cutter blade completely. The pullback spring that is effective between the tie-bar and the protective hood can be designed in the shape of a leg spring, torsion spring, pressure spring or tension spring.

In contrast to the known state of the technology, the protective hood with one-piece design according to the invention protects the worker in a simple and reliable manner against injuries caused by the circular wrapper cutter blade. Owing to the fact that the protective hood formed as one piece must be moved, it is possible to dispense with the more complicated designs that require a movable segment, operated via separate drives, in addition to a rigid protective hood as safeguard against the circular wrapper cutter. The simple protective function of the protective hood is ensured in that as soon as the knife head is lifted off the lower cutter, the protective hood is automatically pushed into the protective position by means of the limit stop arranged on the base body, so that the circular wrapper cutter blade is completely covered in the resting position of the knife head. The limit stop on the base body pushes the protective hood in the direction of the lower cutter. If the knife head moves out into the cutting position, the protective hood is pushed by means of a pullback spring, effective between protective hood and tie-bar, into a working position and is held there.

One advantageous embodiment of the invention provides that the protective hood is positioned such that it can be pivoted in the plane for the circular wrapper cutter. A bearing element that is effective between tie-bar and protective hood is provided to position that protective hood such that it can pivot around this bearing in the plane for the circular wrapper cutter, in such a way that in the operating position, the protective hood is pivoted by an angle as compared to the protective position.

The protective hood for another advantageous embodiment of the invention is positioned such that it can move relative to the circular wrapper cutter. A protective hood, positioned displaceable relative to the circular cutter, is positioned in such a way that the protective hood can perform a translatory movement in the direction of the lifting and lowering movement of the knife head. The protective hood can be positioned, for example, with pins that are connected to the protective hood and are guided inside at least one slot in the tie-bar. It makes sense if on both sides of the circular wrapper cutter axis a slot is arranged which extends lengthwise in the direction of the lifting and lowering movement. It is furthermore possible for the pins to be connected to the tie-bar and to be guided inside a slot in the protective hood. The tie-bar can also have a groove, inside of which a guide block runs that is connected to the protective hood.

One particularly advantageous embodiment of the invention provides for at least one guide element that is effective between the tie-bar and the movable protective hood. The advantage of a guide element that is effective between the tie-bar and the protective hood is that the protective hood, positioned pivoting in particular in the plane for the circular wrapper cutter, is additionally connected to the tie-bar. This results in a better positioning and guidance of the protective hood. A guide element in particular prevents a bending outward on the side of the protective hood, counter to the plane for the circular wrapper cutter. A guide element that is connected to the protective hood can engage, for example, in a slot or groove on the tie-bar. It makes sense in this connection if the slot or groove has the shape of a circular arc traveled by the guide element during a pivoting movement of the protective hood.

A useful embodiment of the invention provides that the limit stop is adjustable. An adjustable design allows this limit stop to be adjusted in such a way that, depending on the application case, the optimum protection position and/or operating position of the protective hood can be adjusted.

One advantageous embodiment of the invention provides for a nearly circular design of the protective hood, wherein the outside diameter of the protective hood is larger than the diameter for the circular wrapper cutter, so that the blade for the circular wrapper cutter is covered completely in the protective position.

In a further advantageous embodiment of the invention, the protective hood is provided with a border, positioned at a right angle relative to the circular wrapper cutter plane, which extends over at least a portion of the circumference for the protective hood. As a result of the border that is bent at a right angle to the circular wrapper cutter plane, the circular wrapper cutter blade is on the one hand protected over at least a portion of the circumference while, on the other hand, one side of the circular wrapper cutter remains accessible so that the circular wrapper cutter can be adjusted, replaced and/or calibrated from this side. The side of the protective hood that faces the lower cutter, in particular, does not have a border so that the protective hood in the operating range of the circular wrapper cutter is covered only by a section of the protective hood in the resting position which runs parallel to the cutter plane.

One useful embodiment of the invention provides that the angled border extends over the full circumference of the circular wrapper cutter and has a slotted opening for the circular wrapper cutter blade in the region that is assigned to its cutting position. Owing to the fact that the angled border has a slotted opening in the region assigned to the cutting position, it is achieved that the circular wrapper cutter blade can extend through the slotted opening when the protective hood is moved to the operating position. If the protective hood is in the protective position, the blade is covered by the angled border with the slotted opening, thus preventing injuries to the worker.

The invention is explained in the following in more detail, with the aid of the schematic drawings for an exemplary embodiment.

DETAILED DESCRIPTION OF THE PREFERRED EMBODIMENTS

Figure 1:
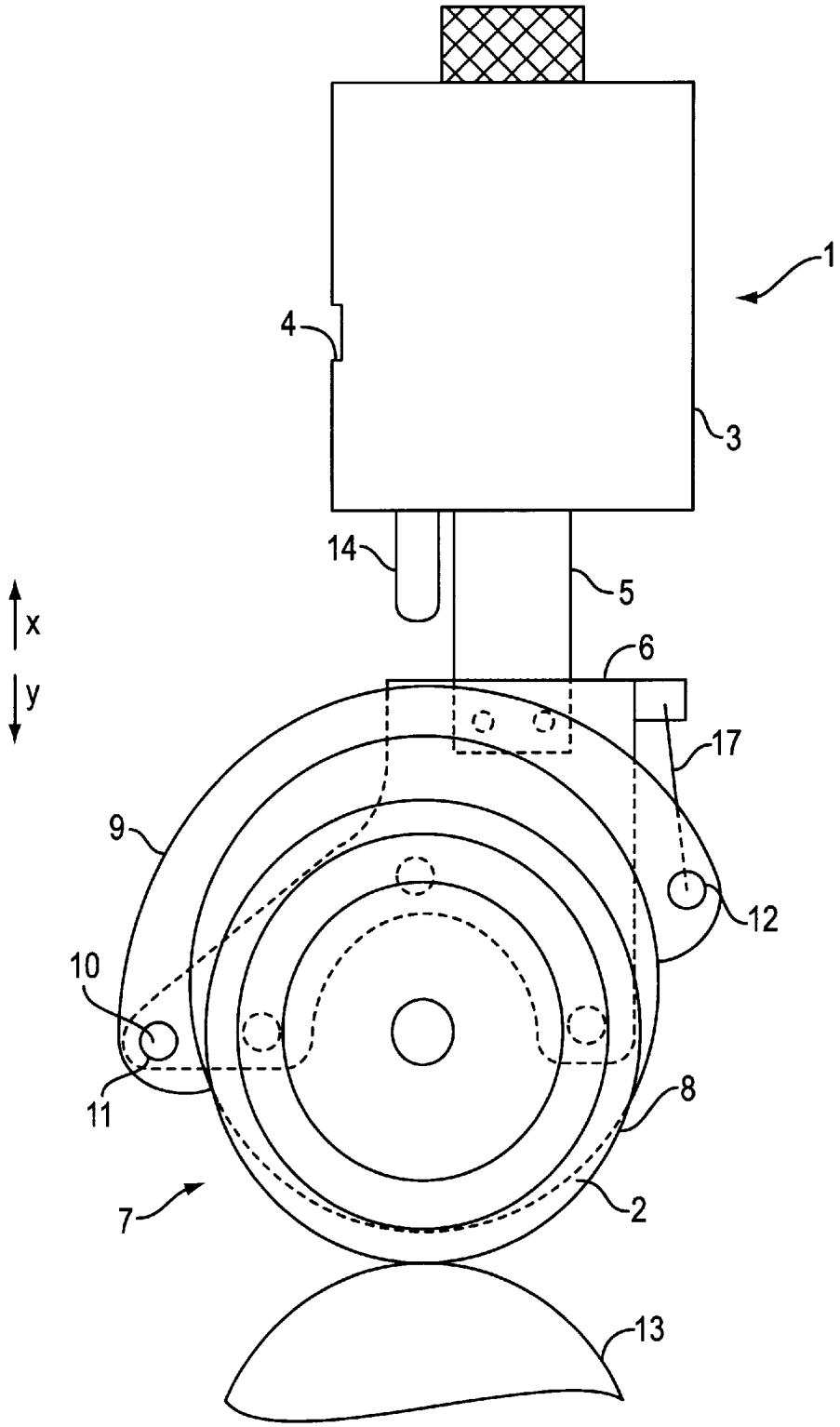
FIG. 1 A view from the side of a knife holder for circular wrapper cutters.

FIG. 1 contains a view from the side of a knife holder 1 for a circular wrapper cutter 2, having a base body 3 which can be rigidly secured to a knife holder bar, not shown in further detail here, with the aid of clamping means and a mounting groove 4. The base body 3 comprises at least one guide rod 5 that can be moved inside the base body 3 with the aid of guides and via a piston-cylinder unit in the base body.

A knife head 7 is positioned on the guide rod 5 by means of a tie-bar 6. The blade for circular wrapper cutter 2 is for the most part covered by a protective hood 9, positioned such that it can pivot around a bearing element 10 in the plane for circular wrapper cutter 2. The bearing element 10 is arranged inside a bore 11 of protective hood 9 and is connected to the tie-bar 6.

Owing to the bore 12, provided in the protective hood 9 for holding a bearing element 10, the protective hood is suitable for a left or right limit stop.

While the knife head 7 is in the cutting position, which is understood to mean that the blade 8 of circular wrapper cutter 2 operates jointly with a lower cutter 13, the protective hood 9 is moved to the operating position by means of a pullback spring 17 in the form of a tension spring that is effective between protective hood 9 and tie-bar 6. As a result of this, the blade 8 of the circular wrapper cutter 2 is exposed and projects over the protective hood 9.

Figure 2:
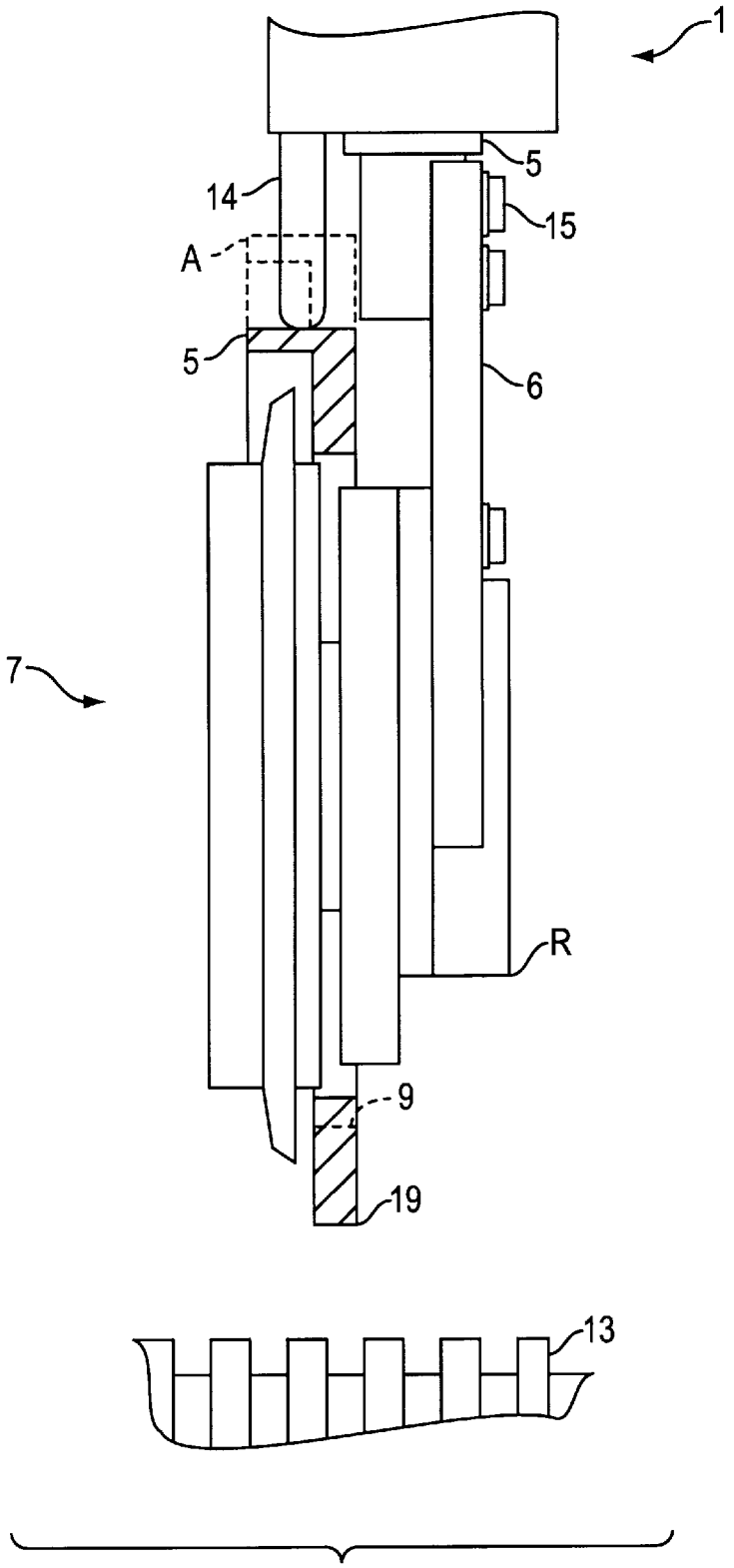
FIG. 2 A partial section of a frontal view of the knife holder according to FIG. 1, with a first embodiment of the protective hood, wherein the knife head is in the resting position.

Depending on the adjustment of a limit stop 14 on the base body 3, the protective hood 9 is forcibly pushed against the limit stop 14 if the knife head 7 is lifted off the lower cutter 13 in the direction of arrow "X." As a result, the protective hood 9 is deflected in the direction of arrow "Y," nearly proportionally counter to the movement of knife head 7, until the blade 8 for the circular wrapper cutter is covered at least by the border of the protective hood, as is indicated in FIG. 2.

FIG. 2 shows a partial section of a frontal view of the knife holder 1 according to FIG. 1, comprising a guide rod 5 to which the tie-bar 6 is connected via screws 15. The knife head 7 in this case is positioned on the tie-bar 6 and is moved to a resting position "R." The fully drawn-out illustration shows the protective hood 9 in the protective position "S," wherein the illustration with dashed lines shows the protective hood in the operating position "A."

In this position, the protective hood 9 is pushed into its protective position "S" by the limit stop 14, arranged so as to be adjustable on the base body 3, if the knife head 7 is lifted off the lower cutter 13. In the protective position "S," the border 19 of protective hood 9 projects over the blade 8 of the circular wrapper cutter 2, so that injuries to the worker are avoided.

Figure 3:
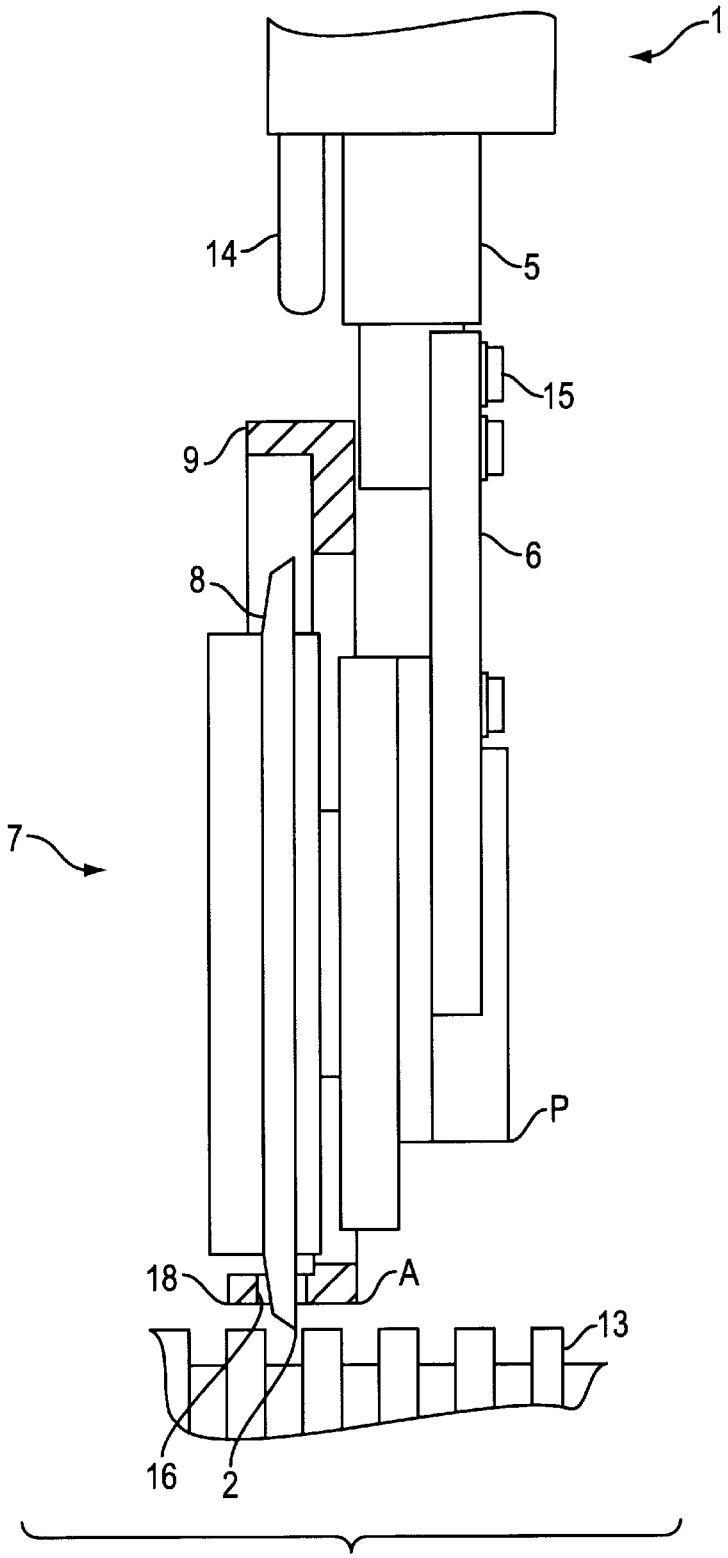
FIG. 3 A partial section of a frontal view of the knife holder according to FIG. 1, showing another embodiment of the protective hood, wherein the knife head is in the cutting position.

FIG. 3 shows the knife holder 1 in the cutting position "P." For the embodiment shown here, the circular wrapper cutter blade 8 is covered by a border 18 that is positioned at a right angle to the place of blade the circular wrapper cutter 8. This border extends over the total circumference and contains a slot 16 in the operating range.

If the knife head 7 is extended in the direction of lower cutter 13, the limit stop 14 no longer pushes against the protective hood 9. Consequently, the protective hood 9 is pivoted to an operating position "A" as a result of the spring force of the pullback spring 17.

If protective hood 9 is in the operating position "A," the circular wrapper cutter 2 can extend through the opening slot 16 in the border 18 that is arranged at a right angle to the circular wrapper cutter plane. It is furthermore possible to move the protective hood with pneumatically, hydraulically or electro-magnetically effective means.

What is claimed is:

1. A knife holder for attachment to a knife holder bar, and for holding a knife head having a circular wrapper cutter with a blade rotatably mounted in the knife head for engagement with a lower cutter to cause lengthwise separation of a material web, the knife holder comprising:

a base body for positioning the knife head;

means for mounting said base body to the knife holder bar;

a tie bar for moving the knife head between a resting position and a cutting position where an area of the blade is exposed and is operatively engaged with the circular wrapper cutter;

a protective hood for covering at least a portion of the circumference of the circular wrapper cutter and movable relative to the circular wrapper cutter between an operating position where the blade is exposed and a protective position where the protective hood covers at least a side of the blade;

a pullback spring disposed between said protective hood and said tie bar for holding said protective hood in the operating position when the circular wrapper cutter is in the cutting position; and a limit stop on the base body for pushing said protective hood into the protective position when the circular wrapper cutter is in the resting position.

2. A knife holder (1) according to claim 1, wherein the circular wrapper cutter rotates about a central axis and lies along a plane perpendicular to the axis and the protective hood is pivotable and remains parallel to said plane when pivoting.

3. A knife holder according to claim 1, wherein the circular wrapper cutter rotates about a central axis and lies along a plane perpendicular to the axis and said protective hood is moveable relative to the circular wrapper cutter and remains parallel to said plane when moving.

4. A knife holder according to claim 1, further comprising at least one guide element connecting said tie-bar and said protective hood.

5. A knife holder according to claim 1, wherein said limit stop is adjustable.

6. A knife holder according to claim 1, wherein said protective hood is substantially circular in shape, and wherein an outside diameter of said protective hood is larger than a diameter of the circular wrapper cutter, so that the blade of the circular wrapper cutter is covered completely when said protective hood in the protective position.

7. A knife holder according to claim 1, wherein the circular wrapper cutter rotates about a central axis and lies along a plane perpendicular to the axis, and said protective hood has a border, positioned perpendicular to said plane and extending over at least a portion of a circumference of the circular wrapper cutter.

8. A knife holder according to claim 7, wherein said border extends over the complete circumference of the circular wrapper cutter and defines a slotted opening for passage of a cutting portion of the circular wrapper cutter blade in the cutting position.

* * * * *